US005466165A

United States Patent [19]

Boesel et al.

[11] Patent Number: 5,466,165

[45] Date of Patent: Nov. 14, 1995

[54] PORTABLE OUTLET ADAPTER

[75] Inventors: George F. W. Boesel, Canton, Mass.; Mark W. Geis, Carmel, Ind.

[73] Assignee: Woods Industries, Inc., Carmel, Ind.

[21] Appl. No.: 402,547

[22] Filed: Mar. 13, 1995

Related U.S. Application Data

[63] Continuation of Ser. No. 178,127, Jan. 6, 1994, abandoned.

[51] Int. Cl.[6] ..... H01R 13/44

[52] U.S. Cl. ..... 439/142; 439/638

[58] Field of Search ..... 439/650, 651, 439/655, 490, 135, 192, 141, 546, 638

[56] References Cited

U.S. PATENT DOCUMENTS

| | | | |
|---|---|---|---|
| D. 121,820 | 8/1940 | Perl . | |
| D. 274,808 | 7/1984 | Schwartz . | |
| D. 285,552 | 9/1986 | Schwartz . | |
| D. 285,787 | 9/1986 | Schwartz . | |
| D. 287,358 | 12/1986 | Schwartz . | |
| D. 315,718 | 3/1991 | Luu . | |
| D. 318,647 | 7/1991 | Dunn, Sr. . | |
| D. 318,849 | 8/1991 | Luu . | |
| D. 324,029 | 2/1992 | Luu . | |
| D. 329,423 | 9/1992 | Luu . | |
| 2,636,096 | 4/1953 | Di Blasi . | |
| 3,938,068 | 2/1976 | Hagan . | |
| 4,545,632 | 10/1985 | Maier et al. | 439/490 X |
| 4,659,161 | 4/1987 | Holcomb | 439/490 OR |
| 4,679,873 | 6/1987 | Brackett, Jr. | 439/135 X |
| 4,705,335 | 11/1987 | Goebel | 439/142 X |
| 4,726,048 | 2/1988 | Waldman et al. . | |
| 4,875,152 | 10/1989 | Foster | 439/490 X |
| 4,897,049 | 1/1990 | Miller et al. . | |
| 4,934,962 | 6/1990 | Luu et al. . | |
| 4,941,166 | 7/1990 | Waldman et al. . | |
| 5,004,435 | 4/1991 | Jammet . | |
| 5,034,856 | 7/1991 | Hodge et al. . | |
| 5,094,630 | 3/1992 | Jammet . | |
| 5,122,082 | 6/1992 | Lee . | |
| 5,124,876 | 6/1992 | Misencik et al. | 439/490 X |
| 5,232,381 | 8/1993 | Yu | 439/655 X |

*Primary Examiner*—David L. Pirlot
*Assistant Examiner*—Daniel Wittels
*Attorney, Agent, or Firm*—McAndrews, Held & Malloy, Ltd.

[57] ABSTRACT

A portable surge protection adapter includes a housing having first and second exterior faces. At least one electrical outlet is mounted in the housing. The outlet has apertures on the first exterior face which are oriented to receive the prongs of a standard electrical plug. An electrical plug mounted in the housing has at least two electrical prongs extending from the second exterior face. The prongs are prongs adapted to deliver electricity to the electrical outlet. A conditioning circuit mounted in the housing is electrically connected between the plug and the outlet. A prong cover pivots between a first position at which the prong cover encloses the prongs and a second position at which the prongs are exposed and insertable into a powered outlet. Data input and output ports are mounted in an exterior face of the prong cover. A data conditioning circuit is connected between the data input and output ports and is mounted in the prong cover.

17 Claims, 5 Drawing Sheets

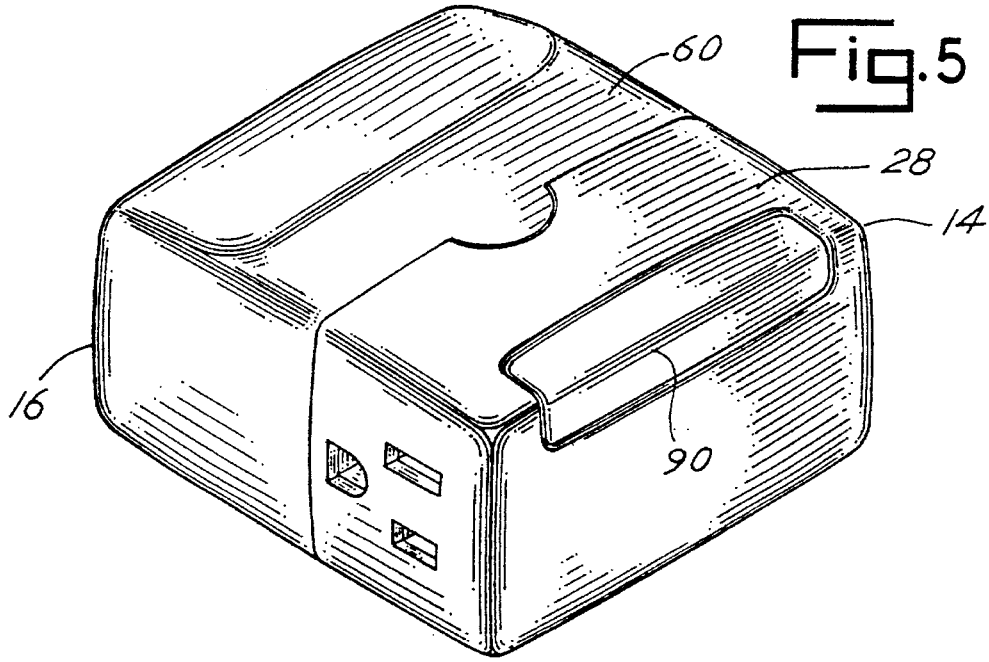
Fig. 5
Fig. 6
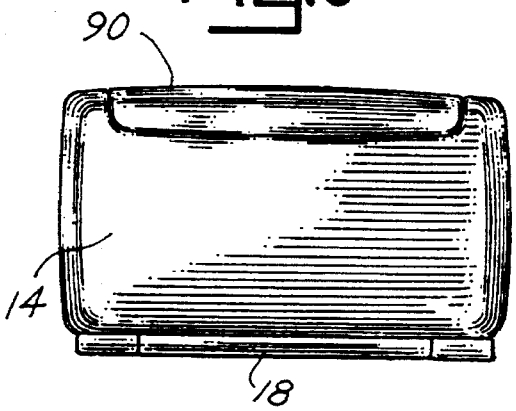
Fig. 7
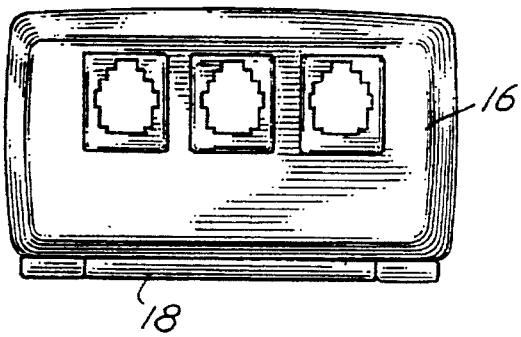
Fig. 8
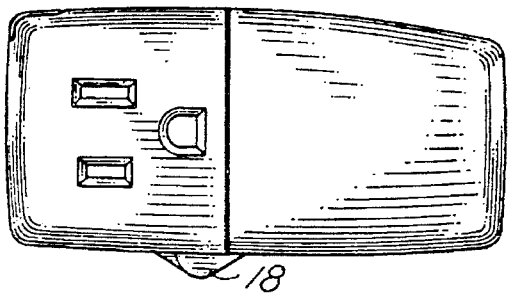

Fig. 9
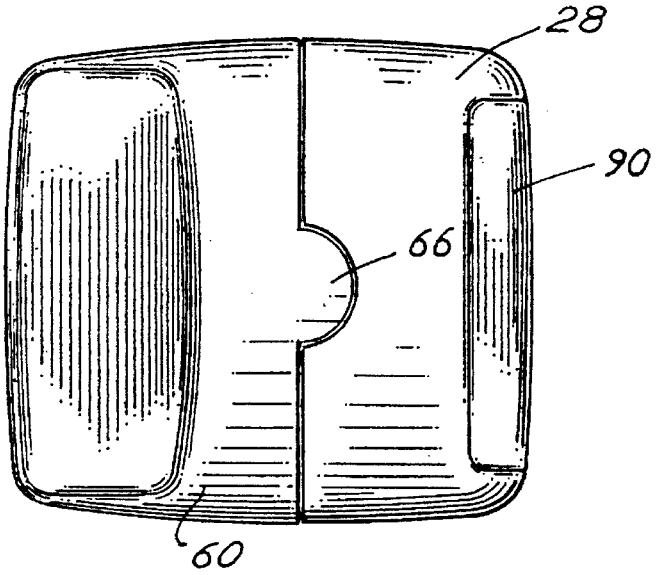
Fig. 10
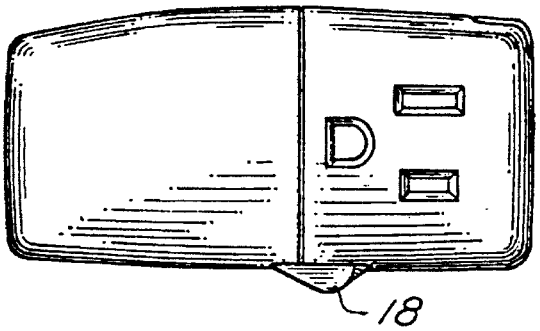
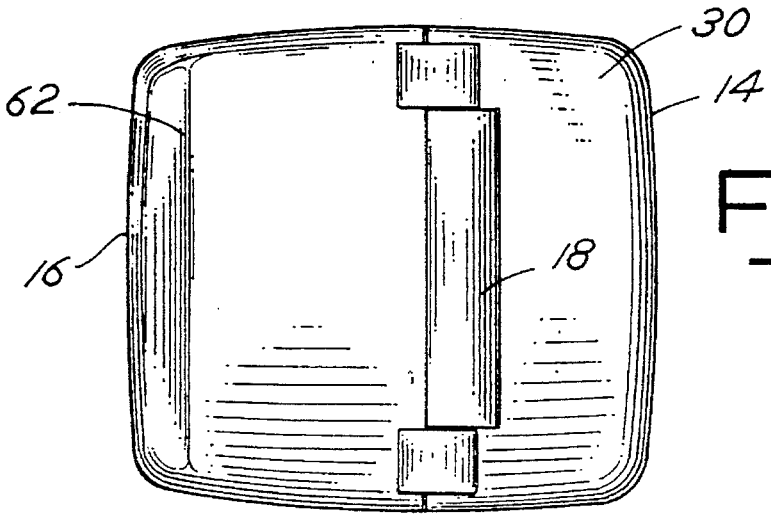
Fig. 11

PORTABLE OUTLET ADAPTER

This is a continuation of application Ser. No. 08/178,127 filed Jan. 6, 1994, now abandoned.

FIELD OF THE INVENTION

The present invention relates to electrical plug adapters designed to be mounted in a standard electrical outlet and provide surge suppression.

BACKGROUND OF THE INVENTION

Most computers and home entertainment devices do not include adequate built-in surge suppression circuits. In the absence of surge protection, transient voltage spikes and power line surges can cause data errors and even permanent damage to the electrical equipment. Hence, it is known to provide multiple outlet strips or adapters which incorporate circuits for suppressing power line voltage spikes and transient surges and/or providing noise suppression.

Conventional electrical outlet adapters typically consist of a rectangular housing having a plurality of electrical outlets formed in one face of the housing. It is not uncommon for an outlet adapter to have six or more electrical outlets. Most outlet adapters include a power cord having one end connected to the housing and the other end terminating in an electrical plug. It is also known to eliminate the power cord by mounting the plug directly in the housing of the outlet adapter.

Due to advent of portable computers it is desirable to provide a surge suppression adapter which is easy to transport. The large size of a conventional outlet adaptors and the inclusion of the power cord make these devices cumbersome to transport. Know outlet adapters also do not include any mechanism for covering the electrical prongs when the adapter is not being used. As a result, the prongs can be bent and they can also scratch or otherwise damage devices being carried with the adapter.

The present invention is directed to overcoming one or more of the above noted problems.

More specifically, an object of the present invention is to provide a portable outlet adapter which has a compact housing.

A further object of the present invention is to provide a portable outlet adapter having a built-in surge suppression circuit.

Another object of the present invention to provide a portable outlet adapter having mechanism for covering the electrical prongs when the adapter is being transported.

Still another object of the present invention is to provide a portable outlet adapter that provides both power line and data line surge protection.

It is yet another object of the present invention to provide a portable outlet adapter which is simple and economical to manufacture.

Other objects and advantages of the invention will become apparent upon reading the following detailed description and appended claims, and upon reference to the accompanying drawings.

SUMMARY OF THE INVENTION

In accordance with one aspect of the present invention a portable surge protection adapter comprises a housing having first and second exterior faces. At least one electrical outlet is mounted in the housing. The outlet has outlet apertures on the first exterior face which are oriented to receive the prongs of an electrical plug. An electrical plug mounted in the housing has its prongs extending from the second exterior face. The prongs are oriented for insertion into a powered outlet and are adapted to deliver electricity to the outlet mounted in the housing. A prong cover is connected to the housing for movement between a first position at which the prong cover encloses the prongs and a second position at which the prongs are exposed and insertable into a powered outlet.

In accordance with another aspect of the present invention a conditioning circuit is mounted in the housing is electrically connected between the plug and the outlet.

BRIEF DESCRIPTION OF THE DRAWINGS

For a more complete understanding of this invention reference should now be had to the embodiment illustrated-in greater detail in the accompanying drawings and described below by way of example of the invention.

In the drawings:

FIG. 5 is a front perspective view of the portable outlet adapter of FIG. 1 in its closed position;

FIG. 6 is a front view of the portable outlet adapter of FIG. 1 in its closed position;

FIG. 7 is a rear view of the portable outlet adapter of FIG. 1 in its closed position;

FIG. 8 is a right side view of the portable outlet adapter of FIG. 1 in its closed position;

FIG. 9 is a top view of the portable outlet adapter of FIG. 1 in its closed position;

FIG. 10 is a left side view of the portable outlet adapter of FIG. 1 in its closed position;

FIG. 11 is a bottom view of the portable outlet adapter of FIG. 1 in its closed position;

DETAILED DESCRIPTION OF THE PREFERRED EMBODIMENTS

Figure 1:
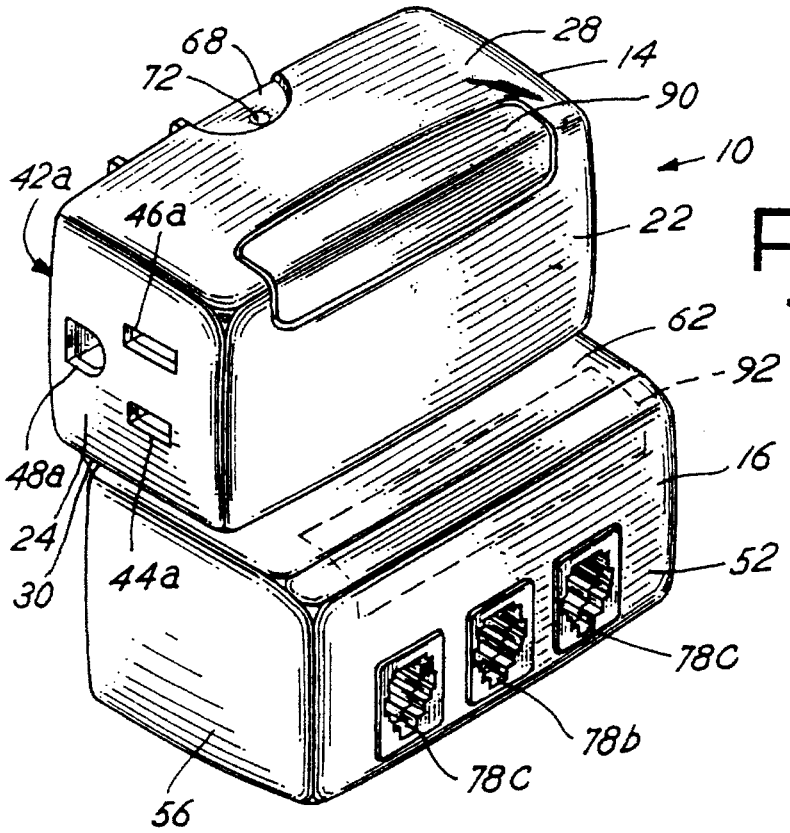
FIG. 1 is a front perspective view of a portable outlet adapter in accordance with the present invention, showing the adapter in its open position.
Figure 2:
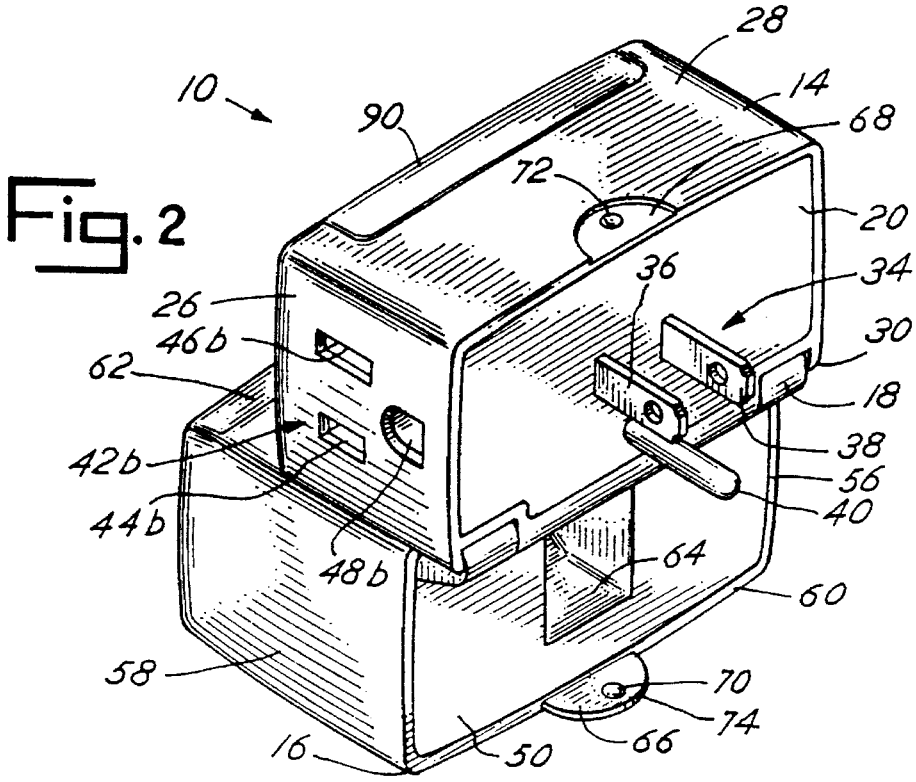
FIG. 2 is a rear perspective view of the portable outlet adapter of FIG. 1 in its open position.
Figure 3:
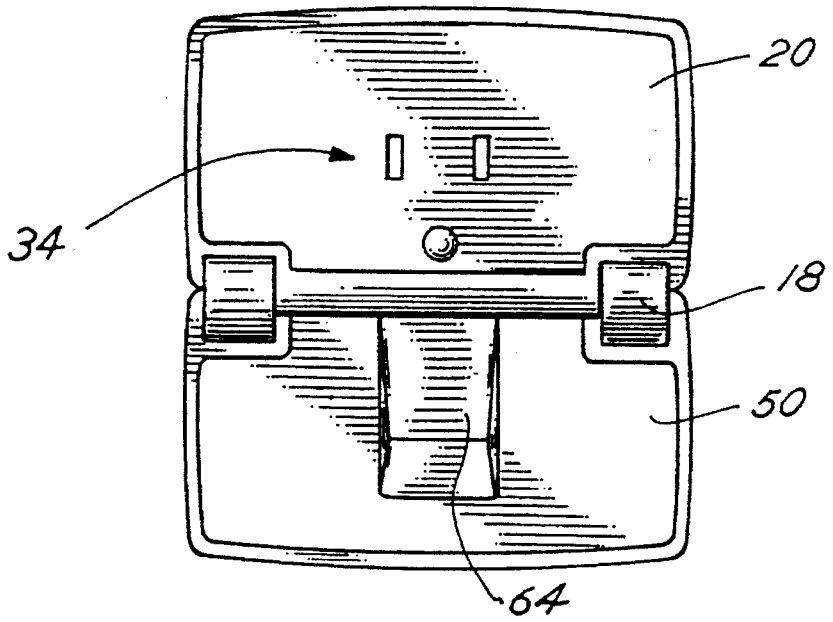
FIG. 3 is a rear view of the portable outlet adapter of FIG. 1 in its open position.
Figure 4:
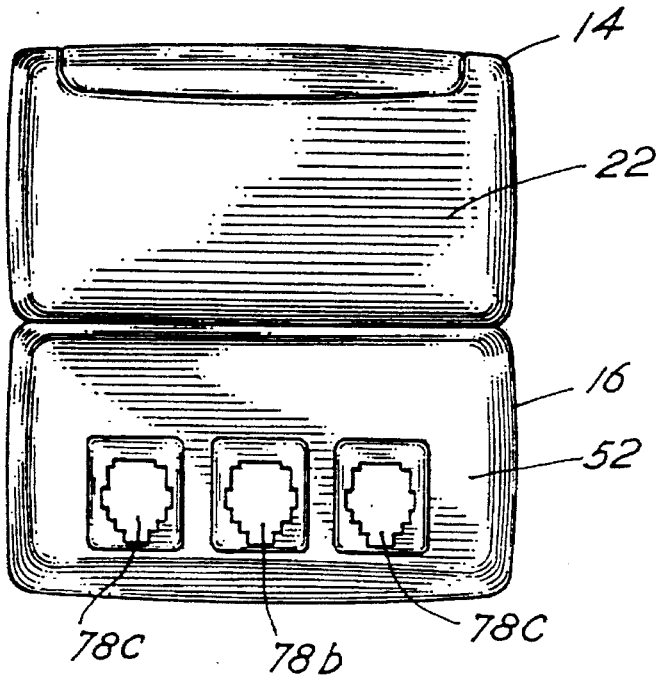
FIG. 4 is a front view of the portable outlet adapter of FIG. 1 in its open position.

In the following detailed description, spatially orienting terms are used such as "left," "right," "vertical," "horizontal," and the like. It is to be understood that these terms are used for convenience of description of the preferred embodiments by reference to the drawings. These terms do not necessarily describe the absolute location in space, such as left, right, upward, downward, etc., that any part must assume.

Referring to FIGS. 1–11, a portable outlet adapter 10 has a main housing 14 and a prong cover 16 pivotally connected about a hinge 18. Main housing 14 and prong cover 16 are both formed from a nonconductive material, such as ABS plastic or polyvinyl chloride (PVC), and are constructed by a conventional manufacturing process such as injection molding.

Main housing 14 is a generally rectangular-shaped box. It includes a flat back panel 20 and a flat front panel 22. Front and back panels 20, 22 are parallel and are spaced apart by two generally square side panels 24, 26, a generally rectangular top panel 28, and a generally rectangular bottom panel 30. Top panel 28 is slightly convex to give adapter 10 a fluid appearance. The top edges of side panels 24, 26, front panel 22, and back panel 20 are curved slightly to conform to the curve of top panel 28.

The panels of main housing 14 are generally of a single thickness leaving an open interior space (not shown). Preferably, front panel 22 is formed separately from back panel 20 and is integrally formed with side panels 24, 26, top panel 28, and bottom panel 30. Back panel 20 is fixedly connected to the other panels during assembly of adaptor 10.

An electrical plug 34 extends from the back panel 20 of main housing 14. (See FIG. 2). Plug 34 includes a line prong 36, a neutral prong 38, and a ground prong 40. Plug 34 is polarized, i.e. neutral prong 38 is wider than line prong 36. Prongs 36–40 extend perpendicularly from back panel 20 and are oriented for insertion into a powered electrical outlet (not shown).

Main housing 14 has at least one electrical outlet 42 carried in one of its panels other than back panel 20. Preferably, main housing 14 includes two electrical outlets 42*a*, 42*b*, each being carried by one of the side panels 24, 26. (See FIGS. 1 and 2). As will suggest itself, additional outlets may be provided and they may be located in any of panel 22, 24, 26, 28, 30 other than back panel 20. Each outlet 42 includes a line prong aperture 44, a neutral prong aperture 46, and a ground prong aperture 48 formed in a respective side panel 24, 26. Prong apertures 44–48 extend completely through side panels 24, 26 of main housing 14 and into the interior space.

Figure 12:
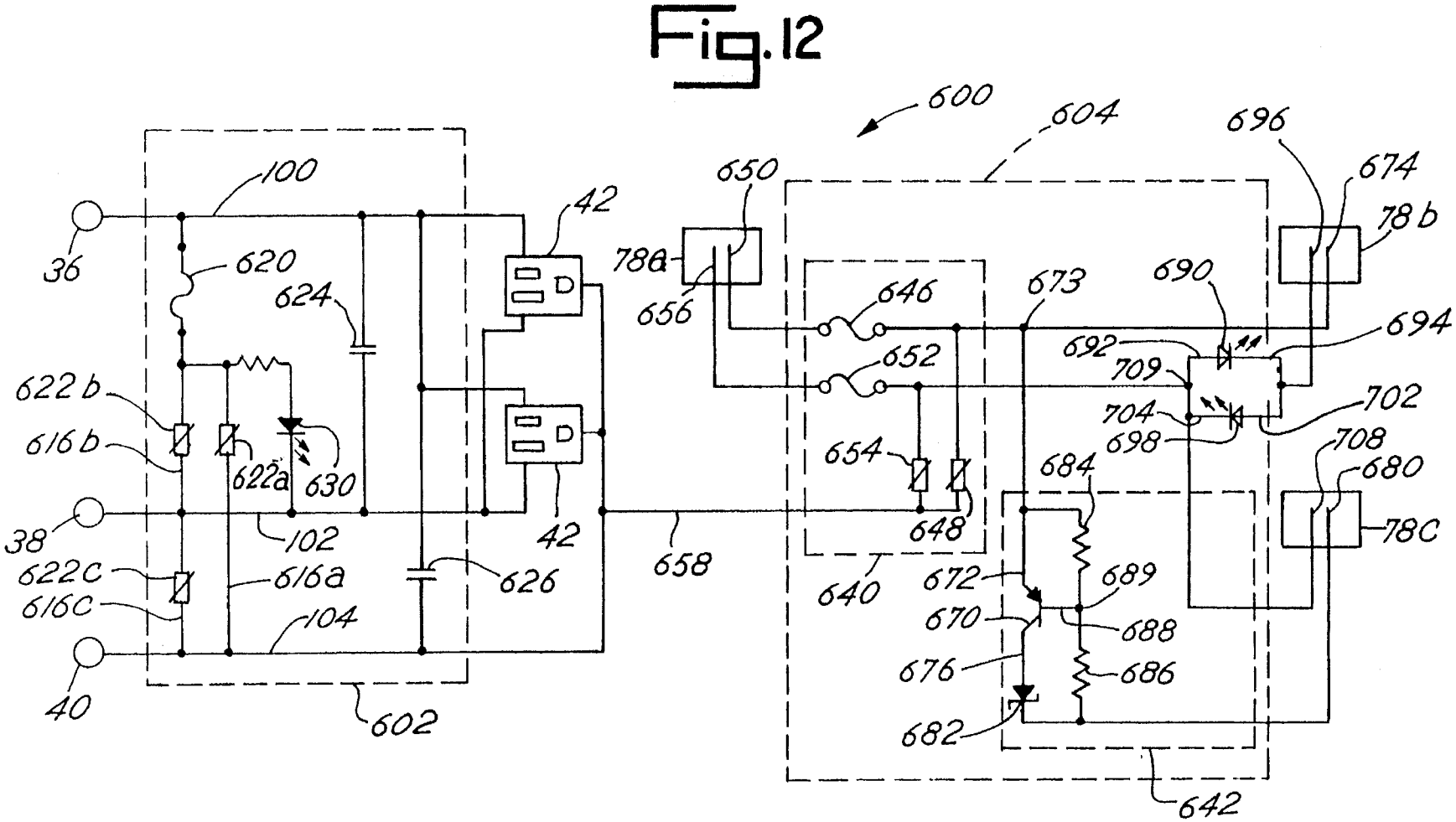
FIG. 12 is an electrical schematic of a circuit used in the portable outlet adapter of FIG. 1.

The interior space of main housing 14 houses three electrical bus bars or contact strips 100, 102, 104 which are shown schematically in FIG. 12. For reference purposes, the contract strips are designated as a line contact strip 100, a neutral contact strip 102, and a ground contact strip 104. Contact strips 100–104 are stamped from metal and include terminals (not shown) formed at each end for receiving the prong from an electrical plug. A contact strip mounting bracket (not shown) is integrally formed in the interior space for supporting contact strips 100–104 and electrically isolating them from each other. Contact strips and support structures of this type are well known in the art and will not be explained in great detail.

When contact strips 100–104 are mounted in main housing 14, their terminals are positioned adjacent the apertures 44, 46, 48, respectively, of outlets 42*a*, 42*b* so as to contact the prongs of plugs inserted into the outlets. Contact strips 100–104 are electrically connected to the prongs 36–40 of plug 34 for delivering power to outlets 42*a*, 42*b*. In particular, line contact strip 100 is electrically connected to line prong 36, neutral contact strip 102 is electrically connected to neutral prong 38, and ground contact strip 104 is electrically connected to ground prong 40.

Prong cover 16 is also a generally rectangular-shaped box. It includes a flat back panel 50 and a flat front panel 52. Front and back panels 52, 50 are parallel and are spaced apart by two generally square side panels 56, 58, a generally rectangular top panel 60, and a generally rectangular bottom panel 62. Top panel 60 is slightly convex and the top edges of side panels 56, 58, front panel 52, and back panel 50 are curved slightly to conform to the curve of top panel 60.

The panels of prong cover 16 are generally of a single thickness leaving an open interior space (not shown). Front panel 52 is formed separately from back panel 50 and is integrally formed with side panels 56, 58, top panel 60, and bottom panel 62. Back panel 50 is fixedly connected to the other panels when adaptor 10 is assembled.

Prong cover 16 is pivotally connected to main housing 14 by hinge 18 and it is movable between a first or closed position (See FIGS. 5–11) at which prong cover 16 encloses prongs 36–40 and a second or open position (See FIGS. 1–4) at which prongs 36–40 are exposed and insertable into a powered outlet. A recess 64 (See FIGS. 2 and 3) formed in the back panel 50 of prong cover 16 is configured to receive electrical prongs 36–40 when prong cover 16 is moved to the closed position. A locking tab 66 (see FIG. 2) extends from the back edge of prong cover top panel 60 in the same plane as top panel 60. When prong cover 16 is in its closed position, its top panel 60 is flush with the top panel 28 of main housing 14 (see FIGS. 5, 8 and 10).

A reciprocal locking groove 68 (see FIG. 1) formed in the top panel 28 of main housing 14 receives locking tab 66 when prong cover 16 is moved to its closed position. A spherical knob 70 formed in the bottom of locking tab 66 engages a reciprocal indentation 72 formed in locking groove 68 so that prong cover 16 "snaps" into its closed position. When prong cover 16 is in its open position, the outer edge 74 of locking tab 66 is flush with the plane of main housing back panel 20 (see FIG. 2). Hence, when adapter 10 is plugged into an outlet, the outer edge 74 of locking tab 66 engages the face plate of the outlet, so as to stabilize prong cover 16 and maintain its front panel 52 generally parallel to the front panel 22 of main housing 14.

Prong cover 16 carries at least two data ports 78, each being adapted to receive a conventional phone jack. Preferably, prong cover 16 has three data ports 78*a–c*, all of which are carried by its front panel 52. (See, FIGS. 1 and 4). As will suggest itself, additional data ports may be provided, and they may be located in any panel 56, 58, 60, 62 other than back panel 52. A first data port 78*a* functions as a line-in port. Line-in port 78*a* can be connected to a wall mounted phone outlet by a conventional phone cord having phone jacks positioned at both ends. Second and third data ports 78*b*, 78*c* function as a modem port and a phone port, respectively. Phone cords can be used to connect the modem port 78*b* to a computer modem and phone port 78*c* to a phone. An internal circuit, explained below in connection with FIG. 12, electrically connects line-in port 78*a* to modem port 78*b* and phone port 78*c*.

Referring to FIG. 12, a circuit 600 which can be used in connection with the portable outlet adapter 10 is described. Circuit 600 is divided into a power portion 602 and a data portion 604. Power portion 602 is mounted in the interior space of main housing portion 14 and data portion 604 is mounted in the interior space of prong cover 16.

Power portion 602 is electrically connected between plug 34 and outlets 42 by attaching lead wires to the contact strips 100–104. Power portion 602 includes three surge suppression branches 616*a*, 616*b*, 616*c*. First surge suppression branch 616*a* includes a first nonresetable fuse 620 and a first varistor 622*a* serially connected between line contact strip 100 and ground contact strip 104. Second surge suppressor branch 616*b* includes first fuse 620 and a second varistor 622*b* serially connected between line contact strip 100 and neutral contact strip 102. Third surge suppression branch 616*c* includes a third varistor 622*c* serially connected between neutral contact strip 102 and ground contact strip 104.

Power portion also includes a first capacitor 624 serially connected between line contact strip 100 and neutral contact strip 102, and a second capacitor 626 serially connected between line contact strip 100 and ground contact strip 104. First and second capacitors 624, 626 function as noise filters and are preferable 1000 picofarad capacitors.

Varistors 622*a–c* are in the form of commercially available metal oxide varistors (MOV). A varistor is a well-known element having a resistance which decreases as the voltage across its terminals increases. Accordingly, when normal voltages are applied to the contact strips 100–104, varistors 622*a–c* present a high impedance to current flow and, hence, normal current levels flow to outlets 42*a*, 42*b*. However, when conductor voltages exceed an acceptable level, e.g. due to lightning or power malfunctions, circuit 602 shunts the power line surges around and away from loads connected to outlets 42*a*, 42*b*. More specifically, when the voltage exceeds a preselected level, the resistance of varistors 622*a–c* drops dramatically and a substantial amount of the current flows through varistors 622*a–c*, as opposed to flowing through outlets 42*a*, 42*b*.

When a varistor fails it essentially functions as a short circuit. Continued current flow through a failed varistor causes heat build-up in the varistor and can potentially present a fire hazard. Fuse 620 is provided to prevent fire hazards in the event one of the first and second varistors 622*a*, 622*b* fails to a short circuit condition. Fuse 620 is sized to burn out, i.e. permanently open, if there is a short-circuit failure in one of the first or second varistors 622*a*, 622*b*.

If fuse 620 burns out, first and second varistors 622*a*, 622*b* are disconnected from the line contact strip 100, but third varistor 622*c* remains connected between the neutral and ground contact strips 102, 104. Hence, when fuse 620 fails, outlets 42*a*, 42*b* continue to function, but no power line surge protection is provided to outlets 42*a*, 42*b*. An indicator light 630, such as an LED, provides the user with an indication that circuit 602 is no longer providing surge protection. Indicator light 630 is serially connected with fuse 620 between line conductor 100 and neutral contact strip 102. Indicator light 630 is positioned in housing main portion 14 such that is visible through a lens 90 in housing first portion 14. (See FIGS. 1 and 2). Indicator light 630 is energized so long as fuse 620 has not burned out. If fuse 620 burns out, power is cut to the indicator lamp 630 to provide the user with a visual indication that circuit 602 has failed.

Data portion 604 of circuit 600 is divided into a data surge protection circuit 640 and a modem control circuit 642. Data surge protection portion 640 includes a second fuse 646 and a fourth varistor 648 serially connected between the green terminal 650 of line-in port 78*a* and ground contact strip 104. A third fuse 652 and a fifth varistor 654 are serially connected between the red terminal 656 of line-in port 78*a* and ground conductor 104. An electrical conductor 658, e.g. a wire, extends between prong cover 16 and main housing 14 to provide the connection between fourth and fifth varistors 648, 654 and ground contact strip 104. Conductor 658 is routed through hinge 18 such that it is not externally exposed and is not subject to bending. For a further understanding of how data surge suppression circuit 640 functions, reference is directed to the above description of power portion 602.

Modem control portion 642 includes a pnp transistor 670 having its emitter 672 connected to the junction of the green terminal 650 of line-in port 78*a* and modem port red terminal 674. The collector 676 of transistor 670 is connector to the phone port green terminal 680 through a zener diode 682. First and second resistors 684, 686 are serially connected between emitter 672 and zener diode 682. In the preferred embodiment, first resistors 684 is 2K ohms and second resistor 686 is 39K ohms. Transistor base 688 is connected to the junction of the first and second resistors 684, 686. A first LED 690 has its input terminal 692 connected to the line-in red terminal 656 and its output terminal 694 connected to the modem port green terminal 696. A second LED 698 has its input terminal 702 connected to modem port green terminal 696 and its output port 704 connected to the line-in red terminal 656. The red terminal 708 from phone port 78*c* is connected to the junction of LEDs 690, 698 and line-in red terminal 656. One of the LEDs 690, 698 will be active whenever modem port 78*c* is being used. LEDs 690, 698 are positioned in adaptor 10 so that they are visible from outside adaptor 10.

Modem control circuit 642 functions to disable phone port 78*c* when modem port 78*b* is in use, thereby preventing phone usage from interfering with data transmission to and from modem port 78*b*. More specifically, a phone needs a preselected voltage potential across its red and green terminals to operate. Typically a phone needs a voltage of at least 6 volts to operate. If the line-in port 78*a* is hooked up in a positive polarity, i.e. red terminal 656 is positive and green terminal 650 is negative, modem control circuit 642 delivers approximately 8.2 volts to phone port 78*c* when phone port 78*c* is being used by itself. However, if the modem port 78*b* is activated, the voltage delivered to phone port 78*c* drops to approximately 1.6 volts—a level insufficient to power a phone. Similarly, if line-in port 78*a* is wired in a negative polarity, i.e. red terminal 656 is negative and green terminal 650 is positive, a voltage of approximately 6.3 volts is applied to phone port 78*c* when the phone is being used by itself. The voltage applied to phone port 78*c* drops to approximately 1.5 volts if the modem port 78*b* is activated, thereby disabling phone port 78*c*. While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A portable outlet adapter for use with a standard electrical plug having a plurality of blades, comprising:

a housing having first and second exterior faces, at least one electrical outlet mounted in said housing and presenting outlet apertures on said first exterior face, said electrical outlet being adapted to receive the blades of a standard electrical plug;

an electrical plug mounted in said housing and having at least two electrical prongs extending from said second exterior face, said electrical prongs being adapted to deliver electricity to said electrical outlet; and a prong cover rotatably connected to said housing and being pivotally movable between a first position at which said prong cover encloses said prongs and a second position at which said prongs are exposed and insertable into a powered outlet.

2. A portable outlet adapter as set forth in claim 1, further comprising a conditioning circuit mounted in said housing and being electrically connected between said electrical plug and said outlet.

3. A portable outlet adapter as set forth in claim 1, wherein said prong cover is pivotally connected to said housing.

4. A portable outlet adapter as set forth in claim 1, wherein said first and second exterior surfaces are on opposite sides of said housing.

5. A portable outlet adapter as set forth in claim 1, wherein said first and second exterior surfaces are adjacent one another and extend perpendicularly from each other.

6. A portable outlet adapter as set forth in claim 2, further comprising an externally visible indicator lamp being controllably energized for indicating predetermined conditions in the conditioning circuit.

7. A portable outlet adapter as set forth in claim 6, further include a lens mounted in said housing, said indicator lamp being positioned in said housing such that it is visible through said lens.

8. A portable outlet adapter as set fourth in claim 5, wherein said housing is made from light permeable material.

9. A portable outlet adapter as set forth in claim 2, wherein the conditioning circuit is a surge suppression circuit.

10. A portable outlet adapter, comprising:

a housing having a back panel and a front panel spaced apart by two generally side panels, a top panel, and a bottom panel;

at least one electrical outlet mounted in said housing interior space and presenting outlet apertures on an exterior panel other than said rear panel;

an electrical plug mounted in said housing and having at least two electrical prongs extending from said rear panel, said electrical prongs being adapted to deliver electricity to said electrical outlet;

a prong cover having a back panel and a front panel spaced apart by two generally side panels, a top panel, and a bottom panel, and a recess formed in said back panel and configured to receive and enclose said prongs, said prong cover being pivotally connected to said housing for movement between a first position at which said prong cover encloses said prongs and a second position at which said prongs are exposed and insertable into a powered outlet.

11. A portable outlet adapter as set forth in claim 10, further comprising a locking means for releasably locking said prong cover in its first position.

12. A portable outlet adapter as set forth in claim 11, wherein said locking means comprises a locking tab extending from said prong cover and a reciprocal locking groove formed in said housing.

13. A portable outlet adapter as set forth in claim 10, further comprising a conditioning circuit mounted in said housing interior space and being electrically connected between said electrical plug and said outlet.

14. A portable outlet adapter as set forth in claim 13, further comprising an externally visible indicator lamp being controllably energized for indicating predetermined conditions in the conditioning circuit.

15. A portable outlet adapter as set forth in claim 14, further include a lens mounted in said housing, said indicator lamp being positioned in said housing such that it is visible through said lens.

16. A portable outlet adapter as set fourth in claim 14, wherein said housing is made from light permeable material.

17. A portable outlet adapter as set forth in claim 13, wherein the conditioning circuit comprises a surge suppression circuit.

* * * * *